US008689526B2

(12) United States Patent
Rabiea

(10) Patent No.: US 8,689,526 B2
(45) Date of Patent: Apr. 8, 2014

(54) SYSTEM AND METHOD FOR FACILITATING OPENING OF PLASTIC BAGS

(76) Inventor: Jeffrey Rabiea, Lattington, NY (US)

( * ) Notice: Subject to any disclaimer, the term of this patent is extended or adjusted under 35 U.S.C. 154(b) by 217 days.

(21) Appl. No.: 13/288,235

(22) Filed: Nov. 3, 2011

(65) Prior Publication Data

US 2013/0111857 A1 May 9, 2013

(51) Int. Cl.
*B65B 43/39* (2006.01)

(52) U.S. Cl.
USPC ..... 53/384.1; 53/492; 53/459; 53/570

(58) Field of Classification Search
USPC ..... 53/459, 492, 570, 384.1
See application file for complete search history.

(56) References Cited

U.S. PATENT DOCUMENTS

| | | | | |
|---|---|---|---|---|
| 3,224,574 | A | 12/1965 | McConnell et al. | |
| 3,393,861 | A | 7/1968 | Clayton et al. | |
| 4,084,265 | A * | 4/1978 | Anfelt | 2/163 |
| 4,385,722 | A * | 5/1983 | Brewill | 383/23 |
| 4,423,583 | A * | 1/1984 | Carey | 52/373 |
| 4,686,814 | A * | 8/1987 | Yanase | 53/459 |
| 5,706,961 | A * | 1/1998 | Morano | 215/11.3 |
| 6,081,928 | A * | 7/2000 | Bourne | 2/161.8 |
| 6,502,371 | B2 * | 1/2003 | DeMatteis | 53/459 |
| 6,715,260 | B1 * | 4/2004 | DeMatteis | 53/390 |
| 7,234,170 | B2 * | 6/2007 | Simic | 2/16 |
| 7,356,852 | B2 * | 4/2008 | Thai | 2/161.7 |
| 7,788,737 | B2 * | 9/2010 | Baker et al. | 2/161.6 |
| 7,908,673 | B2 * | 3/2011 | Kerr-Maddox et al. | 2/163 |
| 2002/0108882 | A1 * | 8/2002 | DeMatteis | 206/554 |
| 2003/0138171 | A1 * | 7/2003 | Kikuchi | 383/63 |
| 2005/0281489 | A1 | 12/2005 | Yeh et al. | |
| 2006/0016154 | A1 * | 1/2006 | Rogers | 53/410 |

* cited by examiner

*Primary Examiner* — Thanh Truong
*Assistant Examiner* — Eyamindae Jallow
(74) *Attorney, Agent, or Firm* — Epstein Drangel LLP; Robert L. Epstein

(57) ABSTRACT

A plastic bag for retaining a food product is formed of first and second plastic sheets sealed along the bottom and sides. The bag has an exterior increased friction surface section proximate the mouth. The bag is used in combination with a glove having an exterior increased friction surface portion. The exterior increased friction portion of the glove engages the increased friction section of the bag to facilitate opening of the mouth of the bag. Preferably, aligned increased friction sections are formed on the exterior surface of opposite sides of the bag and the glove has exterior increased friction portions on the tips of the finger stalls. When the bag is held between the thumb and index finger of the glove user, movement of the thumb and index finger of the glove in opposite directions facilitates opening of the bag.

4 Claims, 4 Drawing Sheets

SYSTEM AND METHOD FOR FACILITATING OPENING OF PLASTIC BAGS

BACKGROUND OF THE INVENTION

1. Field of the Invention

The present invention relates to plastic bags used to transport products such as food from a retail establishment such as a grocery store, delicatessen or restaurant and, more particularly, to a system and method for facilitating the opening of a plastic bag to permit the insertion of the product.

2. Description of Prior Art Including Information Disclosed Under 37 CFR 1.97 and 1.98

Disposable bags made of thin, flexible sheets of transparent plastic, such as polyethylene film, are well known in the art and commonly used in retail establishments such as grocery stores, delicatessens, restaurants to package and protect food products for transport by the customers. The bags are commonly distributed in sheets wound in a roll, connected end to end by perforation lines such that the individual bags they can be separated from the roll.

However, because of the nature of the plastic film sheets from which the bags are formed, the sides of the bag tend to stick together in the area proximate the mouth of the bag, making it difficult to open the bag to insert the product. In order to overcome that problem, plastic bags have been manufactured with exterior embossed surfaces to increase the frictional engagement between exterior surfaces of the bag and the fingers of the individual inserting the product into the bag. See for example U.S. Pat. No. 3,224,574, U.S. Pat. No. 3,393,861 and U.S. Patent Publication No. 2005/0281489.

Although embossing the exterior surface of the bag to create an increased friction surface does facilitate the opening of the bag to permit insertion of the product to some extent, it does not solve the problem completely. There is still a need for an improved system and method for facilitating the opening of such plastic bags to a greater degree.

It is, therefore, a prime object of the present invention to provide a system and method for facilitating the opening of plastic bags.

It is another object of the present invention to provide a system and method for facilitating the opening of plastic bags which includes a plastic bag with an exterior increased friction surface section and a glove with an exterior increased friction surface portions situated at the locations where the glove engages the exterior increased friction surface section of the bag, such as at the tips of the finger potions of the glove.

It is another object of the present invention to provide a system and method for facilitating the opening of plastic bags wherein the exterior increased friction surface section of the bag is situated proximate the mouth of the bag.

It is another object of the present invention to provide a system and method for facilitating the opening of plastic bags wherein exterior increased friction surface sections are located on the front and rear surfaces of the bag, proximate the mouth.

It is another object of the present invention to provide a system and method for facilitating the opening of plastic bags wherein the exterior increased friction surface portions of the glove are adapted to engage the exterior increased friction surface sections of the bag.

BRIEF SUMMARY OF THE INVENTION

In general, the above objects are achieved by the system and method of the present invention which includes a plastic bag for retaining a product. The bag includes first and second plastic sheets sealed along the bottom and sides to form a product retaining enclosure. The sheets each have an unsealed edge which forms an open mouth of the bag to permit insertion of the product. The first sheet of the plastic bag includes an exterior increased friction surface section proximate the bag mouth. The bag is adapted for use in combination with a glove having an exterior increased friction surface portion. The exterior increased friction surface portion of the glove is adapted to engage the exterior increased friction surface section of the first sheet of the bag to facilitate opening of the mouth of the bag to insert the product.

The exterior increased friction surface section of the first sheet is preferably situated adjacent the edge of the first sheet which in part defines the mouth of the bag.

Preferably, the exterior surface of the first sheet of the bag, other than the exterior increased friction surface section, is substantially smooth and non-textured.

The exterior increased friction surface portion of the glove is preferably situated at the tip of the finger stall of the glove.

The exterior increased friction surface section of the first sheet of the bag is preferably formed by embossing the exterior surface of the first plastic sheet.

The first sheet of the bag forms the front of the bag. The second sheet forms the rear of the bag. Preferably, a portion of the rear of the bag extends beyond the edge of the first sheet that partially defines the mouth of the bag.

Preferably, the first sheet of the bag has a handle opening therein.

The second sheet of the bag preferably includes a second exterior increased friction surface section, as well.

In accordance with another aspect of the present invention, a plastic bag for retaining a product is provided. The bag includes first and second plastic sheets sealed along the bottom and sides to form a product retaining enclosure. The sheets each have an unsealed edge which forms an open mouth to permit insertion of the product. Each of the first and second sheets includes an exterior increased friction surface section proximate the bag mouth. The bag is adapted for use in combination with a glove having a exterior increased friction surface portion. The exterior increased friction surface portion of the glove is adapted to engage the exterior increased friction surface sections of the first and second sheets of the bag to facilitate opening of the mouth of the bag to insert the product.

The exterior increased friction surface section of the first sheet is situated adjacent the edge of the first sheet which in part defines the mouth of the bag.

The exterior surface of the first sheet, other than the exterior increased friction surface section, is substantially smooth.

The exterior increased friction surface portion of the glove is preferably situated on the tip of the finger stall of the glove.

In accordance with another aspect of the present invention, a method is provided for facilitating the opening of the mouth of a plastic bag to insert a product utilizing a plastic glove. The method includes the steps of: (a) forming the bag by joining the sides and bottom of two plastic sheets, leaving an unsealed an edge of each of the sheets to form an open mouth; (b) embossing an exterior surface section of one of the sheets proximate the mouth of the bag; (c) forming the glove with an embossed exterior surface portion proximate at least one of the tips of the finger stall thereof; (d) causing the embossed portion of the glove to engage the embossed section of the bag; and (e) manipulating the glove with the embossed portion engaged with the embossed section of the bag so as to open the mouth of the bag.

The method further includes the step of embossing an exterior surface section of the other of the sheets of the bag proximate the mouth of the bag.

BRIEF DESCRIPTION OF THE SEVERAL VIEWS OF DRAWINGS

To these and to such other objects that may hereinafter appears, the present invention relates to a system and a method for facilitating the opening of a plastic bag as described in detail in the following specification and recited in the annexed claims, taken together with the accompanying drawings, in which like numerals refer to like parts and in which:

DETAILED DESCRIPTION OF THE INVENTION

Figure 2:
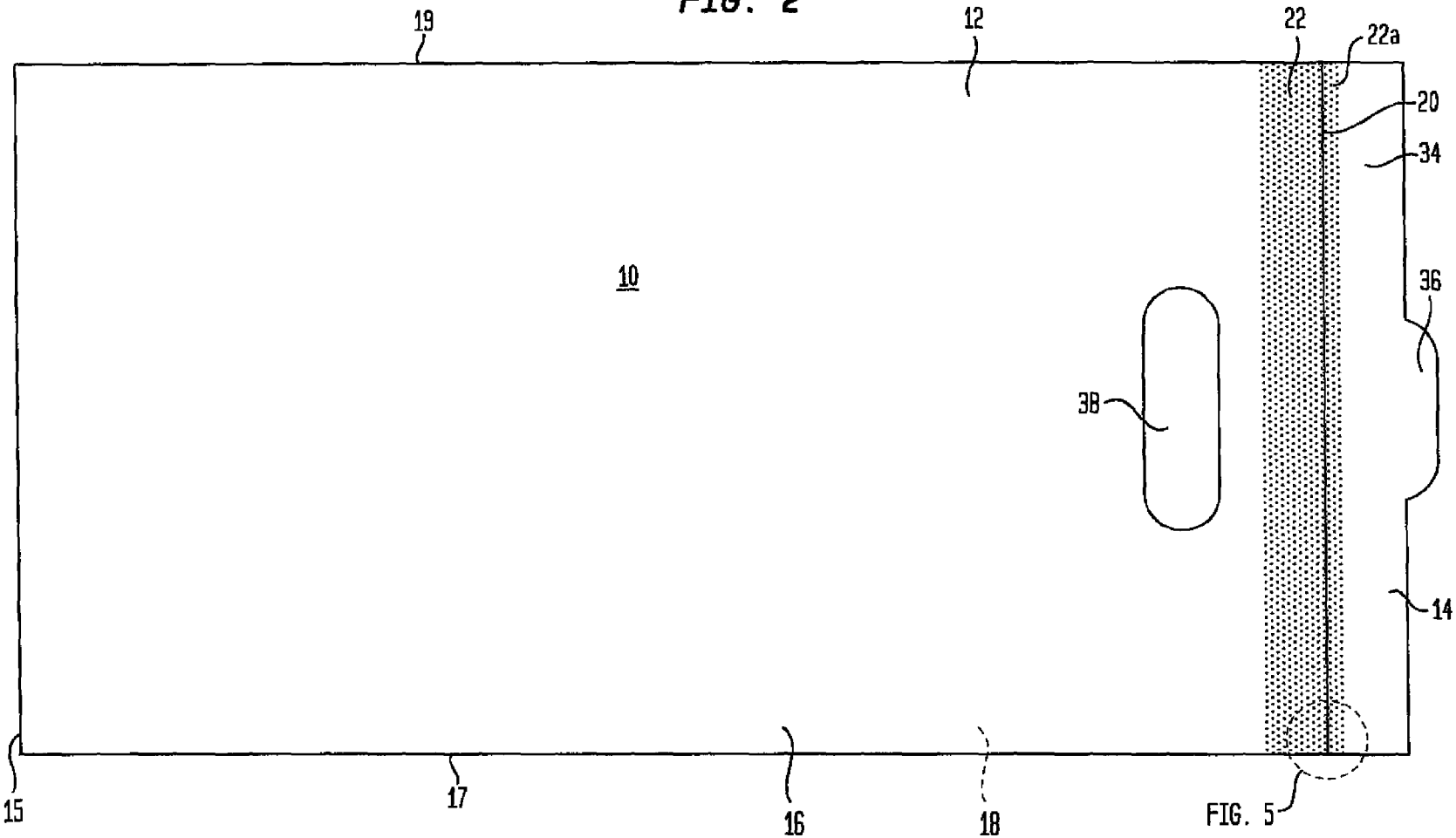
FIG. 2 is a plan view of the front side of the plastic bag of the present invention.
Figure 3:
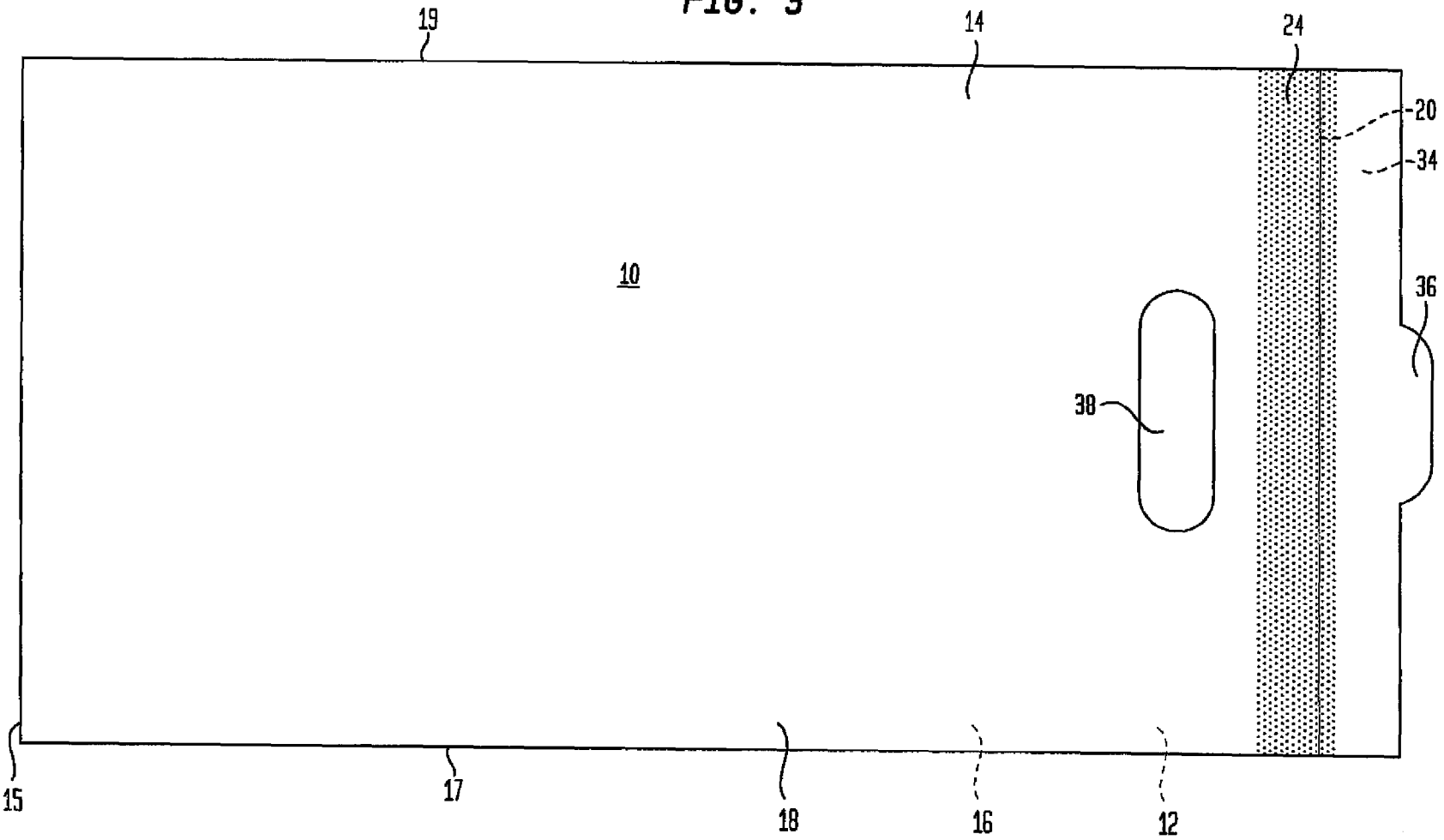
FIG. 3 is a plan view of the rear side of the plastic bag of the present invention.

The present invention relates to a plastic bag 10 for retaining product as illustrated in FIGS. 2 and 3 which respectively show the front 12 and rear 14 of the plastic bag. Bag 10 is formed of a first plastic sheet 16 and a second plastic sheet 18. Sheets 16 and 18 are die cut to the proper size and shape and then heat-sealed along the bottom 15 and sides 17, 19 to form an enclosure. The top edges of sheets 16 and 18 are left unsealed to define an open mouth 20 for the bag to permit insertion of the product.

At least one of the sheets has an exterior increased friction surface section located proximate bag mouth 20. FIG. 2 shows such a section 22. However, it is preferable to provide an exterior increased friction section on each side of the bag proximate mouth 22. Accordingly, FIG. 3 shows the rear of the bag with an exterior increased friction section 24 proximate mouth 22.

Sections 22 and 24 are preferably formed by embossing or any other conventional surface roughening method and are shown in the drawings as being aligned with each other. Although aligning sections 22 and 24 allows a simpler manufacturing process, they need not be aligned.

If sections 22 and 24 are aligned and of the same size, as shown in the drawings, a small increased friction section 22*a* may be formed on the interior surface of sheet 18, adjacent section 22 on sheet 16, during the manufacturing process. That is a result of the manufacturing process and should not adversely affect the utility of the present invention.

Figure 1:
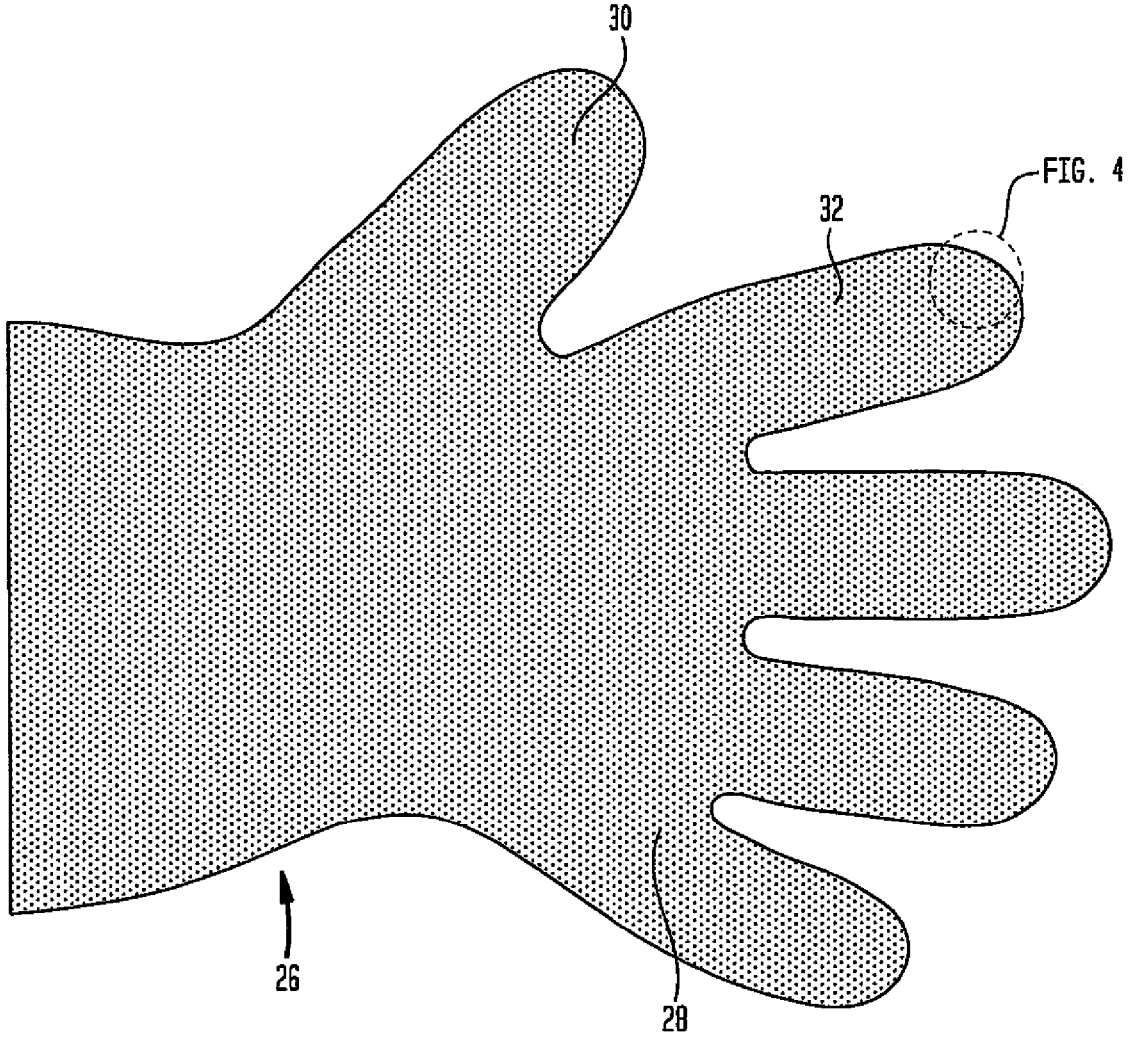
FIG. 1 is a plan view of one side of the glove of the present invention, the other side being substantially the mirror image thereof.

Also included in the invention is a plastic glove 24 illustrated in FIG. 1. Glove 24 has an exterior increased friction surface portion 28 which, as illustrated, may cover the entire glove but at a minimum covers the tip of each of the finger stalls 30 and 32 for the thumb and index finger of the glove. If the exterior increased friction portions of the glove are situated at the tips of the finger stalls only, the remainder of the exterior of the glove may be smooth.

The exterior increased friction surface portion 28 of glove 26, such as the portion at the tip of the finger stall 30, is adapted to engage the exterior increased friction surface section 22 of first sheet 16 to facilitate opening of the mouth 20 of bag 10 to insert the product.

Preferably, the exterior increased friction surface portion 28 of glove 26, such as the portion at the tip of the finger stall 32, is adapted to engage the exterior increased friction surface section 24 of second sheet 18. In this manner, moving the thumb and index finger in opposite directions will provide the maximum facility for opening of the mouth 20 of bag 10 quickly and easily to insert the product.

Figure 4:
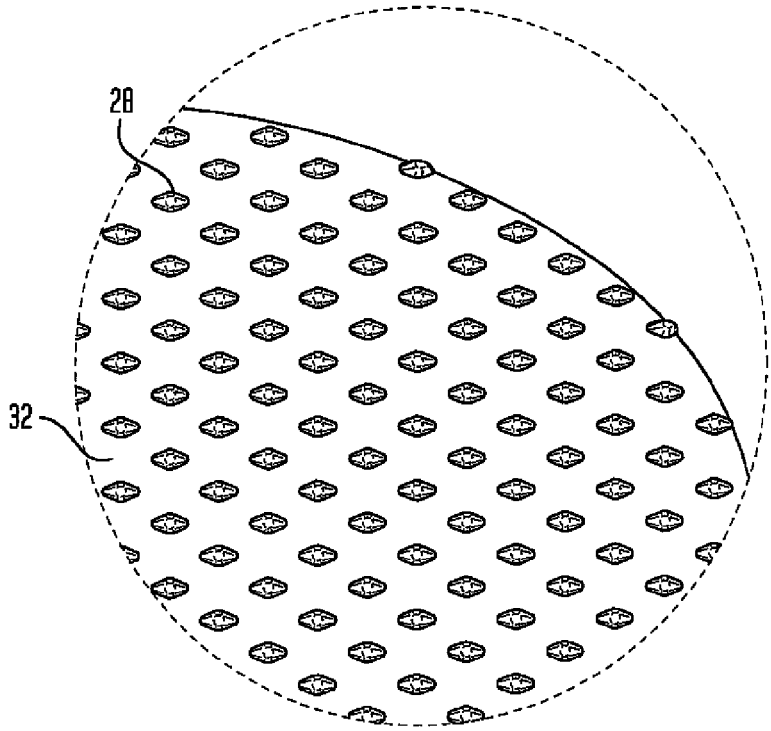
FIG. 4 is a greatly enlarged plan view of the encircled embossed portion of the tip of the finger stall for the index finger of the glove of FIG. 1 showing the detail thereof.
Figure 5:
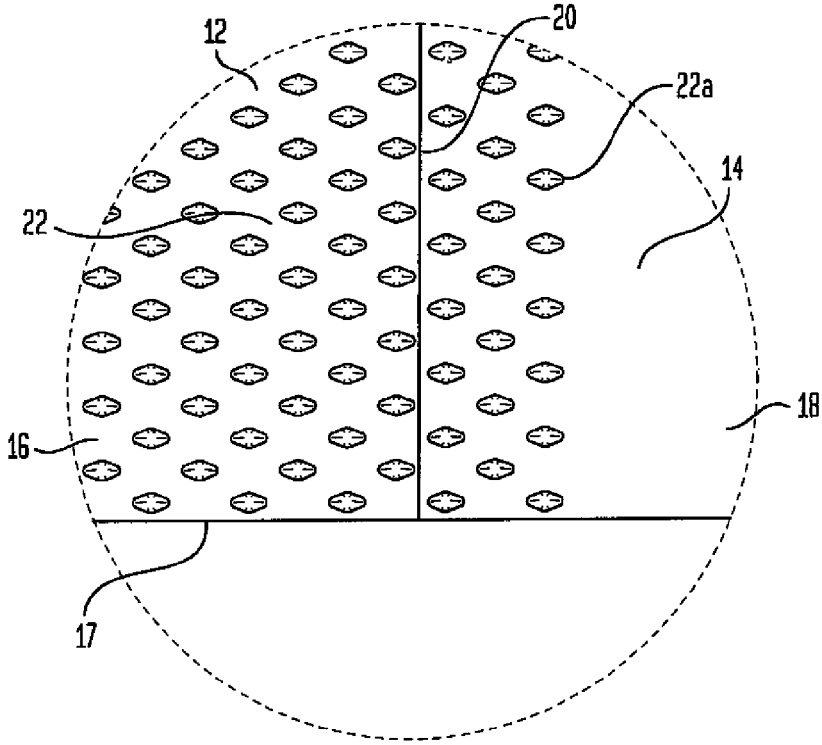
FIG. 5 is a greatly enlarged plan view of the encircled embossed section of the plastic bag of FIG. 2 showing the detail thereof.

The increased friction sections 22 and 24 of the bag, and the increased friction portion 28 of the glove, are preferably formed by embossing using a pressure roller with a suitably roughened surface, to form a texture on the surface of the plastic sheet, as shown on FIGS. 4 and 5 by the spaced oval elements. The increased friction surfaces can be formed in the plastic sheet material either before or after the bags or gloves themselves are formed. Typically, forming the entire exterior of the glove with an increased friction surface simplifies the glove manufacturing process.

As illustrated in FIGS. 2 and 3, section 34 of the sheet 18 which forms the rear of the bag extends beyond the unattached edge 20 of sheet 16 which forms the front surface of the bag. Section 34 is preferably provided with an outwardly extending centrally located tab 36 which facilitates grasping of the rear of the bag. Further, the sheets 16 and 18 are each preferably provided with an oval shaped handle opening 38.

The method includes the steps of: (a) forming a bag 10 by joining the bottom 15 sides 17 of two plastic sheets 12, 14, leaving an unsealed an edge of each of the sheets 12, 14 to form an open mouth; (b) embossing an exterior surface section 22 of one of the sheets 12 proximate the mouth of the bag to form an increased friction surface; (c) forming a glove 26 with an embossed exterior surface portion 28 proximate at least one of the tips of the finger stall 30, 32 thereof; (d) causing the embossed portion 28 of the glove 26 to engage the embossed section 22 of the bag; and (e) manipulating the glove with the embossed portion 26 engaged with the embossed section 22 of the bag so as to open the mouth of the bag.

The method further includes the step of embossing an exterior surface section 24 of the other of the sheets 18 of the bag proximate the mouth of the bag.

Preferably, the tip of the finger stall 30 of the glove for the thumb and the tip of the finger stall 32 of the glove for the index finger each has an exterior increased friction surface portion. In practice, that allows portion of the bag proximate the mouth to be held between the thumb and the index finger of the glove user such that the increased friction exterior surface portion of the glove at the tip of the finger stall 30 for the thumb engages the increased friction exterior surface sections 22 on one side of the bag and the exterior increased surface portion of the tip of the finger stall 32 for the index finger engages the exterior increased friction surface section 24 on the other side of the bag such that the sheets proximate the mouth of the bag can be easily separated by moving the thumb and index finger in opposite directions to open the mouth of the bag.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

I claim:

1. A method for facilitating the opening of the mouth of a plastic bag to insert a product utilizing a plastic glove, the method comprising the steps of:

(a) forming a bag with an open mouth by joining the sides and bottom of two plastic sheets;

(b) embossing an exterior surface section of one of the sheets proximate the mouth of the bag;

(c) forming a glove;

(d) embossing an exterior surface portion of the glove proximate at least one of the tips of the finger stalls thereof;

(e) engaging the embossed exterior surface portion of the glove and the embossed exterior surface section of the bag; and (f) manipulating the glove with the enclosed exterior surface portion engaged with the embossed exterior surface section of the bag so as to open the mouth of the bag.

2. The method of claim 1 further comprising the step of embossing an exterior surface section of the other of the sheets proximate the mouth of the bag.

3. The method of claim 2 further comprising the step of embossing a second exterior surface portion of the glove.

4. The method of claim 3 further comprising the step of engaging the exterior surface section of the other of the sheets and the second exterior surface portion of the glove with at least one.

* * * * *